US009070280B2

(12) United States Patent
Baker et al.

(10) Patent No.: US 9,070,280 B2
(45) Date of Patent: Jun. 30, 2015

(54) REMOTE AND CONTROLLER SYNCHRONIZATION FOR AUTOMATED FURNITURE CONTROLS

(71) Applicant: L & P PROPERTY MANAGEMENT COMPANY, South Gate, CA (US)

(72) Inventors: Chad Baker, Georgetown, KY (US); Ryan Edward Chacon, Carthage, MO (US); Dave Jones, St. Charles, MO (US); David M. Linhoff, St. Peters, MO (US); Larry Nicholas Nibert, O'Fallon, MO (US); William Rohr, Joplin, MO (US)

(73) Assignee: L&P PROPERTY MANGEMENT COMPANY, South Gate, CA (US)

( * ) Notice: Subject to any disclaimer, the term of this patent is extended or adjusted under 35 U.S.C. 154(b) by 184 days.

(21) Appl. No.: 13/749,108

(22) Filed: Jan. 24, 2013

(65) Prior Publication Data

US 2014/0203920 A1 Jul. 24, 2014

(51) Int. Cl.
*G08C 17/02* (2006.01)

(52) U.S. Cl.
CPC ..... *G08C 17/02* (2013.01); *G08C 2201/20* (2013.01)

(58) Field of Classification Search
CPC ... G08C 17/02; G08C 2201/20; H04W 76/02; H04W 76/023
USPC ..... 340/12.5, 3.2, 4.3, 5.1, 13.24; 370/242; 700/275; 455/41.1, 41.2; 725/37
See application file for complete search history.

(56) References Cited

U.S. PATENT DOCUMENTS

| | | | | |
|---|---|---|---|---|
| 8,533,475 | B2 * | 9/2013 | Frikart et al. | 713/171 |
| 8,544,054 | B2 * | 9/2013 | Reams et al. | 725/133 |
| 8,554,140 | B2 * | 10/2013 | Klemmensen | 455/41.2 |
| 2013/0189925 | A1 * | 7/2013 | Staskawicz et al. | 455/41.1 |

* cited by examiner

*Primary Examiner* — Toan N Pham
(74) *Attorney, Agent, or Firm* — Shook, Hardy & Bacon L.L.P.

(57) ABSTRACT

A system and method for automatically pairing wireless remotes to the control components of automated furniture items is provided. In embodiments, a pairing mode selection indication is received, indicating a universal mode selection or a normal mode selection. In universal mode, the control component and the remote device are automatically paired based on commands received from the remote device. In normal mode, the control component and the remote component are automatically paired upon confirmation that the unique ID of the remote device corresponds to an ID database. Having paired the control component with the remote device, the control component may execute commands received from at least one remote device. In embodiments, the pairing method includes applying priority rules for particular remote devices. Further, the automatic pairing of remote devices may include varying levels of authorization for different users.

19 Claims, 2 Drawing Sheets

REMOTE AND CONTROLLER SYNCHRONIZATION FOR AUTOMATED FURNITURE CONTROLS

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

Embodiments of the present invention generally relate to a system and method for synchronizing automated furniture remotes and controllers. More particularly, embodiments of the present invention relate to a system and method for automatically pairing a wireless, remote device with a control component of an automated furniture item such that the remote device may communicate commands to the control component, and the control component may receive and execute such commands.

BACKGROUND OF THE INVENTION

A variety of methods exist for pairing wireless remotes to the control components of automated furniture items. For some automated furniture items, a manufacturer may preprogram a control component to pair the control component with a particular remote device provided to the user at the time of purchase. Alternatively, a user may purchase a wireless remote device from a third-party manufacturer, which requires manual pairing of the third-party remote device to a control component of an automated furniture item. Manual pairing of the third-party remote device to the automated furniture item may require physical manipulation of one or both of the control component and the remote device. For example, a wireless, third-party remote device may be paired to a control component using manual entry, by a user, of a particular key code or synchronization logic, or by depressing and holding a button on the device for a specified amount of time.

Accordingly, a need exists for an automated method of pairing wireless, remote devices to control components of automated furniture items, without the need to manually synchronize either the control components or the remote devices.

BRIEF SUMMARY OF THE INVENTION

The present invention generally relates to a system and method for synchronizing automated furniture remotes and controllers. More particularly, embodiments of the present invention relate to a system and method for pairing a wireless, remote device with a control component of an automated furniture item such that the remote device may communicate commands to the control component, and the control component may receive and execute such commands. Embodiments of the invention include a system and method for pairing a wireless remote device to a control component using a universal mode or a normal mode, and for executing commands received by the control component from the automatically-paired remote device.

In one illustrative embodiment of the invention, a system for automatically pairing a wireless, remote device with a control component of an automated furniture item comprises a control component comprising 1) a pairing mode selector configured to receive a pairing mode selection indication; and 2) a first wireless communication device, wherein one or more features of the automated furniture item are controlled by at least one remote device automatically paired to the control component, wherein the at least one remote device comprises a second wireless communication device and a unique ID.

In another illustrative aspect, a method of automatically pairing at least one remote device with a control component of an automated furniture item comprises receiving a pairing mode selection indication, and executing one or more commands received from at least one remote device, the at least one remote device associated with a unique ID.

According to a third illustrative aspect, embodiments of a method of automatically pairing at least one remote device with a control component of an automated furniture item comprise: upon receiving an indication of a universal mode selection, automatically pairing a control component with a first remote device when the control component is in universal mode, wherein automatically pairing the control component with the first remote device comprises: 1) receiving a first command from the first remote device, the first remote device having a unique ID; and 2) executing the first command received from the first remote device; and upon receiving an indication of a normal mode selection, automatically pairing the control component with a second remote device when the control component is in normal mode, wherein automatically pairing the control component with the second remote device comprises: 2) receiving a second command from the second remote device, the second remote device having a unique ID; 2) determining that the unique ID of the second remote corresponds to an ID in the control component's ID database; and 3) executing the second command received from the second remote device.

Additional objects, advantages, and novel features of the invention will be set forth in part in the description which follows, and in part will become apparent to those skilled in the art upon examination of the following, or may be learned by practice of the invention.

BRIEF DESCRIPTION OF SEVERAL VIEWS OF THE DRAWING

The present invention is described in detail below with reference to the attached drawing figures, wherein.

DETAILED DESCRIPTION OF THE INVENTION

Figure 1:
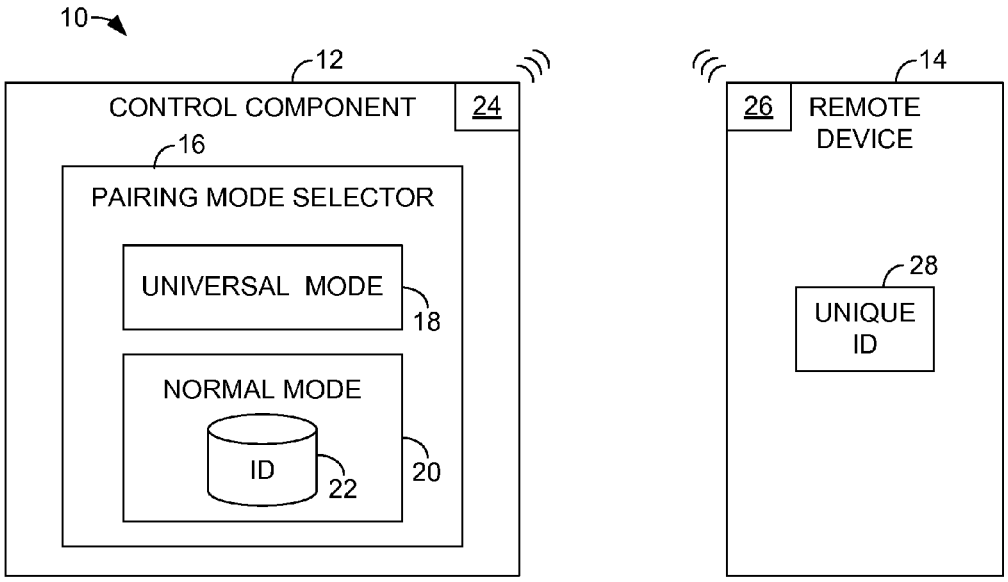
FIG. 1 is a system for automatically pairing a wireless, remote device with a control component of an automated furniture item, in accordance with an embodiment of the invention.

An embodiment of a system 10 for automatically pairing a wireless, remote device with a control component of an automated furniture item is seen in FIG. 1. The system 10 generally includes a control component 12 in wireless communication with a third-party, remote device 14. Further, the control component 12 includes a pairing mode selector 16, having both a universal mode selector 18 and a normal mode selector 20. The normal mode selector 20 is associated with an ID database 22. Control component 12 also includes a wireless communication device 24 in wireless communication with the wireless communication device 26 of remote device 14.

In one embodiment, control component 12 controls various features of an automated furniture item based on commands received by the control component 12 from a remote device. For example, the control component 12 may control integrated features that operate the automated furniture item, such as a head motor that raises and lowers the head of an adjustable bed. In further embodiments, the control component 12 may control one or more automated furniture accessories coupled to the control component 12. As such, a wireless, remote device 14 paired with the control component 12 may communicate commands for one or more features, integrated or external to the automated furniture item, that are executed by the control component 12. In embodiments of the invention, a control component 12 receives and executes commands from the remote device 14 upon pairing of the particular remote device 14 and the particular control component 12. Accordingly, automatic "pairing" of a third-party remote device 14 to the control component 12 may enable two-way communication between the control component 12 and the remote device 14 that would not otherwise be authorized and/or enabled without manual pairing.

In some embodiments, the control component 12 includes a processor and a memory capable of receiving and executing commands that are identifiable by the firmware of the control component 12. For example, the control component 12 may process commands received from a remote device 14, and may also initiate requests for information from the remote device 14. Control component 12 also includes a pairing mode selector 16 having both a universal mode selector 18 and a normal mode selector 20. As described below, the control component 12 and the remote device 14 may be paired in universal mode based on receiving an indication of a universal mode selection, while the control component 12 may be paired in normal mode based on receiving an indication of a normal mode selection.

In embodiments, universal mode may be used to automatically pair a control component 12 and a remote device 14, regardless of the particular unique ID 28 of the remote device 14. In one example, any remote device 14 from a third party manufacturer (i.e. an "after market" remote, not provided with the purchase of the automated furniture item) may control an automated furniture item in universal mode, as the control component 12 executes any command received in universal mode. Accordingly, a remote device 14 may be automatically paired to a control component 12 in universal mode upon receipt of an initial command from the remote device 14. In another embodiment, a control component 12 in normal mode must first determine whether the unique ID 28 of the remote device 14 corresponds to an ID in an ID database 22. In one example, normal mode is used to automatically pair a control component 12 to particular remote devices 14 from third party manufacturers (i.e. those with the correct unique ID 28). As such, a remote device 14 may be automatically paired to a control component 12 in normal mode upon both receiving an initial command from the remote device 14 and determining that the unique ID of the remote device 14 corresponds to an ID in an ID database 22.

In further embodiments, wireless communication device 24 may be used in the transmission of data between the control component 12 and the paired remote device 14. As such, wireless communication device 24 may be any wireless communication device used to transmit wireless communication to and from one or more remote devices 14 that communicate wirelessly with the control component 12. For example, the wireless communication device 24 may be a wireless device that executes a two-way communication protocol, such as a MiWi and/or Zigbee protocol. In some embodiments, wireless communication device 24 is used to communicate wirelessly between the control component 12 and the wireless communication device 26 of remote device 14. Wireless communication device 26 may also be a wireless device that executes a two-way communication protocol, such as a MiWi and/or Zigbee protocol.

In a first example, the control component 12 may be automatically paired, in universal mode, to the remote device 14. In one embodiment, having received an indication of universal mode selection by universal mode selector 18, the control component 12 continuously accepts commands from all available remote devices 14. Upon receipt of a command from a remote device 14, the control component 12 is automatically paired with the remote device 14. As a result, the control component 12 may add the unique ID 28 of the remote device 14 to a database of trusted remote IDs. In other words, the control component 12 may be paired with any remote device 14, regardless of the particular unique ID 28. In one embodiment, the number of remote devices 14 that may be paired to a particular control component 12 may be fixed when in universal mode, such that a limit is set on the maximum number of paired remote devices 14. In further embodiments, a database of trusted remote IDs generated during pairing in universal mode is cleared upon a power cycle of the control component 12. Accordingly, the next time the control component 12 is turned on, a new database of trusted remote IDs may be established upon pairing.

In another example, the control component 12 may be automatically paired, in normal mode, to the remote device 14. In one embodiment, having received an indication of normal mode selection by normal mode selector 20, the control component 12 executes commands from remote device 14 having an associated unique ID 28 that corresponds to a unique ID in ID database 22. For example, ID database 22 may include a list of unique IDs for any number of remote devices 14 authorized for pairing with the control component 12 when in normal mode. As such, the control component 12 may receive a command from a remote device 14 that is not executed by the control component 12 until confirmation that the unique ID 28 of the remote device 14 is included in ID database 22.

As noted in the universal mode and normal mode pairing examples above, in some embodiments, a specific number of remote devices 14 may be paired with a control component 12. Accordingly, in some embodiments, multiple remote devices 14 may be used to control a single, automated furniture item having a single control component 12. In another embodiment, a single remote device 14 may be used to control multiple automated furniture items having separate control components 12. As such, by utilizing the unique ID 28 to automatically pair in universal mode, the control component 12 may recognize which remote devices 14 will communicate commands. Similarly, by utilizing the unique ID 28 to automatically pair in normal mode, the control component 12 confirms the pairing of remote devices 14 having unique IDs 28 that correspond to the ID database 22.

Figure 2:
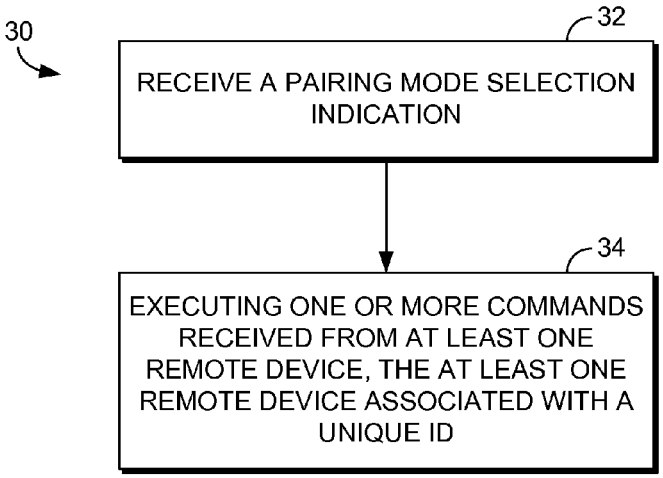
FIG. 2 is flow diagram of a method for automatically pairing a wireless, remote device with a control component of an automated furniture item, in accordance with an embodiment of the invention.

Referring next to FIG. 2, an exemplary flow diagram 30 depicts a method for automatically pairing a wireless, remote device with a control component of an automated furniture item. A pairing mode selection indication is received at block 32. In one embodiment, receiving a pairing mode selection indication comprises receiving an indication of a universal mode selection or an indication of a normal mode selection. The control component may receive an indication of a universal mode selection or an indication of a normal mode selection in a variety of ways, including communication to the control component by manipulation of a switch or other manual and/or automatic feature of the control component. In some embodiments, the control component may already be set to universal mode or normal mode when provided to a user, such that the "received" indication of a pairing mode selection is provided prior to user manipulation of the automated furniture item. In one example, the control component receives an indication of a universal mode selection or a normal mode selection when power is provided to the control component, and the control component is turned on in a pre-selected mode.

At block 34, commands received from at least one remote device are executed. The at least one remote device is associated with a unique ID. Accordingly, based on a successful pairing of a control component and a remote device, received commands may be executed by the control component.

In embodiments, a control component in universal mode receives a command from a remote device, and is automatically paired to the remote device upon receipt of the command. In one example, automatically pairing the remote device in universal mode may also include transmitting a token key command comprising a request for the unique ID of the remote device, and adding the unique ID of the remote device to a database of trusted remote IDs. As discussed above, the unique ID of the remote device may be used for recognition of which remote devices are paired in universal mode.

In further embodiments, a control component in normal mode receives a command from a remote device, and is automatically paired to the remote device upon confirmation that the remove device's unique ID corresponds to an ID in the ID database. The control component in normal mode may also transmit a token key command comprising a request for the unique ID of the remote device, for comparison with the ID database, and confirmation of the authority to execute commands received from such remote device.

Figure 3:
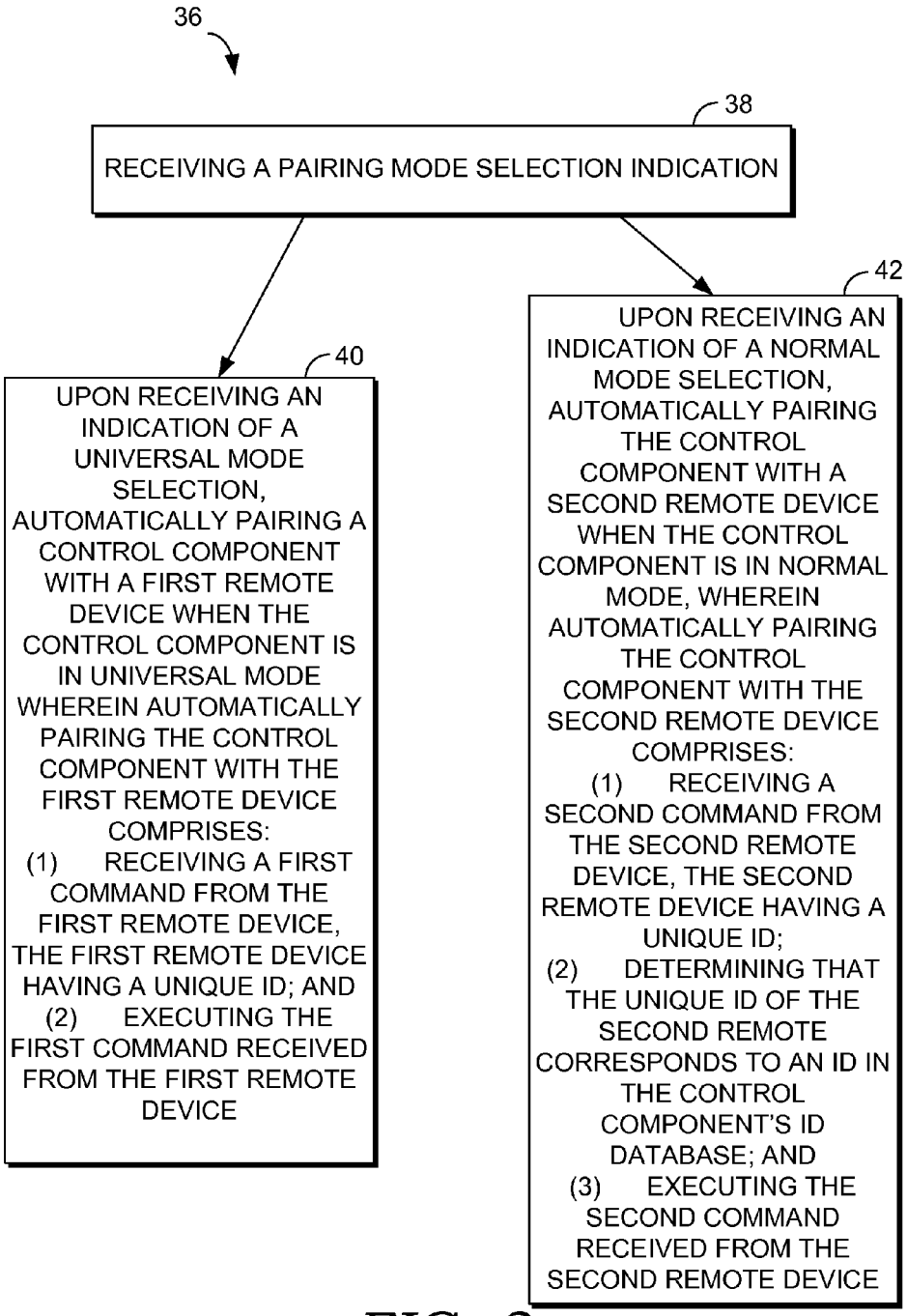
FIG. 3 is a flow diagram of a method for automatically pairing a wireless, remote device with a control component of an automated furniture item, in accordance with an embodiment of the invention.

Turning finally to FIG. 3, flow diagram 36 depicts a method for automatically pairing a wireless, remote device with a control component of an automated furniture item. At block 38, a pairing mode selection indication is received. At block 40, having received a universal mode selection indication, a control component is automatically paired with a first remote device when the control component is in universal mode. In one embodiment, automatically pairing the control component with the first remote device comprises: 1) receiving a first command from the first remote device, the first remote device having a unique ID; and 2) executing the first command received from the first remote device. At block 42, having received an indication of a normal mode selection, the control component is automatically paired with a second remote device when the control component is in normal mode. In another embodiment, automatically pairing the control component with the second remote device comprises: 1) receiving a second command from the second remote device, the second remote device having a unique ID; 2) determining that the unique ID of the second remote corresponds to an ID in the control component's ID database; and 3) executing the second command received from the second remote device.

In embodiments of the invention, automatic pairing in universal mode may include transmitting a token key command comprising a request for the unique ID of a remote device, and adding the unique ID of the remote device to a database of trusted remote IDs. In further embodiments, automatic pairing may also include determining a priority for the remote device compared to one or more other remote devices communicating with the control component. In some embodiments, as multiple remote devices may be paired to a single control component, the control component may apply varying levels of priority and/or control to the multiple remote devices, such as restrictions on a level of control available to a particular remote device. In one example, a remote device may be automatically paired to the control component in universal mode, but the control component may assign a lower priority to commands received from the particular remote device based on the timing of the pairing compared to an earlier paired remote device. In doing so, the unique ID of each remote device is used to distinguish between commands received from each device. In further embodiments, the unique ID associated with a remote device may be used to authorize varying levels of control based on an identity of a user associated with a particular remote device, such as a child's remote device receiving restricted control.

In some embodiments, automatic pairing in normal mode may also include determining a priority for a remote device compared to one or more other remote devices communicating with the control component. For example, the control component's ID database may include a priority for receipt of commands from the corresponding remote devices. In another embodiment, a control component paired in normal mode to a remote device may execute commands received from a remote device according to particular restrictions for the particular remote device, as identified using the unique ID of the remote device. For example, particular remote devices may be given certain "authority" over particular functions of an automated furniture item. Accordingly, the control component may receive commands from a remote device having a unique ID listed in the ID database, but may only execute particular commands from the identified remote device. For example, although a unique ID of a remote device corresponds to the IDs in the ID database, the control component may only execute commands for particular functions of the automated furniture item. In embodiments, the unique ID of the remote device may be used to assign levels and/or degrees of control to particular users of an automated furniture item. In the example of multiple remote devices paired to a single control component, the unique IDs of the remote devices may be use to designate different levels of authority to different paired remote devices and/or different users.

From the foregoing, it will be seen that this invention is one well adapted to attain all the ends and objects hereinabove set forth together with other advantages, which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A system for automatically pairing a wireless, remote device with a control component of an automated furniture item comprising:

a control component comprising:

(1) a pairing mode selector configured to receive a pairing mode selection indication; and (2) a first wireless communication device;

wherein one or more features of the automated furniture item are controlled by at least one remote device automatically paired to the control component, wherein the at least one remote device comprises a second wireless communication device and a unique ID.

2. The system of claim 1, wherein the pairing mode selector comprises at least one universal mode selector and at least one normal mode selector.

3. The system of claim 2, wherein receiving a pairing mode selection indication comprises receiving an indication of a universal mode selection or an indication of a normal mode selection.

4. The system of claim 3, wherein the control component is automatically paired to the at least one remote device based on:

1) receiving an indication of a universal mode selection, and 2) receiving a command from the at least one remote device.

5. The system of claim 3, wherein the control component is automatically paired to the at least one remote device based on:

1) receiving an indication of a normal mode selection;

2) determining that the unique ID of the at least one remote device corresponds with at least one ID in an ID database of the control component; and 3) executing a command received from the at least one remote device.

6. The system of claim 1, wherein the first wireless communication device and the second wireless communication device transmit data using Zigbee communication.

7. A method of automatically pairing at least one remote device with a control component of an automated furniture item, the method comprising:

receiving a pairing mode selection indication, wherein receiving a pairing mode selection indication comprises receiving an indication of a universal mode selection or an indication of a normal mode selection; and executing one or more commands received from at least one remote device, the at least one remote device associated with a unique ID.

8. The method of claim 7, wherein executing one or more commands received from at least one remote device comprises:

1) receiving an indication of a universal mode selection, and 2) receiving one or more commands from the at least one remote device such that the control component and the at least one remote device are automatically paired upon receipt of the one or more commands.

9. The method of claim 8, wherein automatically pairing the control component and the at least one remote device upon receipt of the one or more commands comprises:

transmitting a token key command comprising a request for the unique ID of the at least one remote device; and adding the unique ID of the at least one remote device to a database of trusted remote IDs.

10. The method of claim 7, wherein executing one or more commands received from at least one remote device comprises:

1) receiving an indication of a normal mode selection;

2) determining that the unique ID of the at least one remote device corresponds with at least one ID in an ID database of the control component; and 3) based on determining that the unique ID corresponds with at least one ID in the ID database, executing a command received from the remote device such that the control component and the at least one remote device are automatically paired upon executing the command.

11. The method of claim 10, wherein determining that the unique ID of the at least one remote device corresponds with at least one ID in an ID database of the control component comprises transmitting a token key command comprising a request for the unique ID of the at least one remote device.

12. A method of automatically pairing at least one remote device with a control component of an automated furniture item, the method comprising:

upon receiving an indication of a universal mode selection, automatically pairing a control component with a first remote device when the control component is in universal mode, wherein automatically pairing the control component with the first remote device comprises:

(1) receiving a first command from the first remote device, the first remote device having a unique ID; and (2) executing the first command received from the first remote device; and upon receiving an indication of a normal mode selection, automatically pairing the control component with a second remote device when the control component is in normal mode, wherein automatically pairing the control component with the second remote device comprises:

(1) receiving a second command from the second remote device, the second remote device having a unique ID;

(2) determining that the unique ID of the second remote corresponds to an ID in the control component's ID database; and (3) executing the second command received from the second remote device.

13. The method of claim 12, wherein automatically pairing a control component with a first remote device when the control component is in universal mode comprises:

transmitting a token key command comprising a request for the unique ID of the first remote device; and adding the unique ID of the first remote device to a database of trusted remote IDs.

14. The method of claim 12, wherein automatically pairing a control component with a first remote device when the control component is in universal mode comprises determining a priority for the first remote device compared to one or more other remote devices communicating with the control component.

15. The method of claim 12, wherein receiving a first command from the first remote device comprises establishing wireless, two-way communication between the control component and the first remote device.

16. The method of claim 15, wherein the wireless, two-way communication between the control component and the first remote device is Zigbee communication.

17. The method of claim 12, wherein automatically pairing a control component with a second remote device when the control component is in normal mode comprises determining a priority for the second remote device compared to one or more other remote devices communicating with the control component.

18. The method of claim 12, wherein receiving a second command from the second remote device comprises establishing a wireless, two-way communication relationship between the control component and the second remote device.

19. The method of claim 18, wherein the wireless, two-way communication between the control component and the second remote device is Zigbee communication.

* * * * *